US010251495B2

(12) United States Patent
Theilen

(10) Patent No.: US 10,251,495 B2
(45) Date of Patent: Apr. 9, 2019

(54) DEVICE FOR MOUNTING WALL OBJECTS

(71) Applicant: Jerry D. Theilen, Mason City, IA (US)

(72) Inventor: Jerry D. Theilen, Mason City, IA (US)

( * ) Notice: Subject to any disclaimer, the term of this patent is extended or adjusted under 35 U.S.C. 154(b) by 13 days.

(21) Appl. No.: 15/295,655

(22) Filed: Oct. 17, 2016

(65) Prior Publication Data

US 2017/0108166 A1 Apr. 20, 2017

Related U.S. Application Data

(60) Provisional application No. 62/241,905, filed on Oct. 15, 2015.

(51) Int. Cl.

| | |
|---|---|
| ***E04B 1/24*** | (2006.01) |
| ***A47G 1/16*** | (2006.01) |
| ***E04B 1/26*** | (2006.01) |
| ***B25B 5/00*** | (2006.01) |
| ***B25B 5/02*** | (2006.01) |
| ***B25B 5/06*** | (2006.01) |
| *A47G 1/20* | (2006.01) |

(52) U.S. Cl.

CPC ..... *A47G 1/16* (2013.01); *B25B 5/006* (2013.01); *B25B 5/02* (2013.01); *B25B 5/068* (2013.01); *E04B 1/24* (2013.01); *E04B 1/26* (2013.01); *A47G 1/205* (2013.01)

(58) Field of Classification Search

CPC . B25B 11/02; B25B 5/16; B25B 5/163; E04B 2001/2415; E04B 2001/2644

See application file for complete search history.

(56) References Cited

U.S. PATENT DOCUMENTS

| | | | | | |
|---|---|---|---|---|---|
| 939,368 | A | * | 11/1909 | Withem | F22B 37/202 122/510 |
| D45,052 | S | * | 12/1913 | Vail | D8/349 |
| 1,346,955 | A | * | 7/1920 | Gustafson | F16B 12/46 248/188 |
| 2,217,788 | A | * | 10/1940 | Blake | H02K 5/00 248/638 |
| 2,277,576 | A | * | 3/1942 | Anderson | B25H 1/0057 408/111 |
| 3,184,800 | A | * | 5/1965 | Nelson | E04B 1/2608 403/217 |
| 3,493,202 | A | * | 2/1970 | Jensen | A47B 96/061 248/248 |
| 4,120,446 | A | * | 10/1978 | Fuemmeler | A47G 29/1203 232/17 |

(Continued)

*Primary Examiner* — Tyrone V Hall, Jr.
(74) *Attorney, Agent, or Firm* — Zarley Law Firm, P.L.C.

(57) ABSTRACT

The present invention relates to a device for mounting wall objects. The device has a vertical member and a horizontal member attached to one another along a fold line. The vertical member has a wall-facing side that engages and is secured to a wall or surface by receiving connection members through one or more mounting holes. The horizontal member, in some arrangements, has a pair of flanges that form a gap along an outer end opposite the fold line. A pair of spaced-apart support braces that form a slot extend generally down the middle between the horizontal and vertical member. The slot allows for the reception of a brace or clamp that can be held in place by inserting a locking pin through aligned sets of locking holes and through either a brace hole in the brace or a fixing hole in a transverse hole of the clamp.

20 Claims, 4 Drawing Sheets

(56) References Cited

U.S. PATENT DOCUMENTS

| | | | | | |
|---|---|---|---|---|---|
| 4,489,500 | A | * | 12/1984 | Valat | G01B 5/0025 33/394 |
| 4,965,980 | A | * | 10/1990 | Leavens | E04B 1/2608 52/105 |
| 5,076,553 | A | * | 12/1991 | Wright | B25B 11/00 269/101 |
| 5,113,971 | A | * | 5/1992 | Violet | E04G 3/26 182/45 |
| D375,038 | S | * | 10/1996 | Trevorrow | D8/354 |
| D400,081 | S | * | 10/1998 | Ibaragi | D8/354 |
| 6,073,405 | A | * | 6/2000 | Kasai | E04B 1/2403 403/270 |
| 6,171,540 | B1 | * | 1/2001 | Ibaragi | B29C 45/00 248/200 |
| 7,721,476 | B2 | * | 5/2010 | Tumlinson | G09F 7/18 256/65.14 |
| 9,751,193 | B2 | * | 9/2017 | Evatt | B25B 5/068 |
| 2004/0211140 | A1 | * | 10/2004 | Suzuki | E04B 1/24 52/393 |
| 2012/0098182 | A1 | | 4/2012 | Yang | |

* cited by examiner

DEVICE FOR MOUNTING WALL OBJECTS

CROSS REFERENCE TO RELATED APPLICATION

This application claims the benefit of U.S. Provisional Application No. 62/241,905 filed Oct. 15, 2015.

BACKGROUND OF THE INVENTION

This invention is directed to a mounting device and more particularly a mounting device for hanging wall objects.

Hanging or mounting an object, such as a gun rack or ledger board for instance, on a wall or other surface is a labor intensive undertaking. This is attributed to either the size, shape, or weight of the object that is being hung.

One of the primary difficulties arises with leveling the object that is going to be hung on the surface. Leveling the object often requires the use of more than two hands. Even if an individual is able to level the object, the individual must maintain the level position of the object while the correct tools are retrieved to fasten the object to the surface at any and all points of securement.

A related difficulty arises with one person being able to hold the object while securing the object to the desired surface. Due to the size, shape, or weight of the object, it is impractical, if not impossible for a single person to hang the object without some degree of assistance from another. The need for additional persons on hand can lead to delays in completing a project, which can increase costs related to wasted time and payment of additional hired help.

For those who do not wait for help, there are risks of harm to the individual from dropping the object. Similarly, if the object is dropped, there is a risk of damage to the object. Also, if a mistake is made during the hanging process, unnecessary holes or damage is done to the surface the object is supposed to be hung on, which can lead to increased costs and delays related to repairs. In the event that the surface is not repaired, the object may be misaligned or the damaged surface will diminish the aesthetics of the project.

There is a need in the art for a device that addresses these deficiencies. Thus it is a primary objective of this invention to provide a device for mounting wall objects that improves upon the state of the art.

Another objective of this invention is to provide a device for mounting wall objects that allows an individual to hang an object without the assistance of another person.

Yet another objective of this invention is to provide a device for mounting wall objects that makes it easy to level an object.

Another objective of this invention is to provide a device for mounting wall objects that limits the damages caused to surfaces.

Yet another objective of this invention is to provide a device for mounting wall objects that is small in size.

Another objective of this invention is to provide a device for mounting wall objects that accommodates various sizes of clamps.

Yet another objective of this invention is to provide a device for mounting wall objects that is high quality and durable.

Another objective of this invention is to provide a device for mounting wall objects that is easy to use.

Yet another objective of this invention is to provide a device for mounting wall objects that is low cost to make.

Another objective of this invention is to provide a device for mounting wall objects that works without clamps.

Yet another objective of this invention is to provide a device for mounting wall objects that is lightweight.

Another objective of this invention is to provide a device for mounting wall objects that works with objects of various sizes, shapes, and weights.

These and other objectives, features, and advantages of the invention will become apparent from the specification and claims.

SUMMARY OF THE INVENTION

Figure 1:
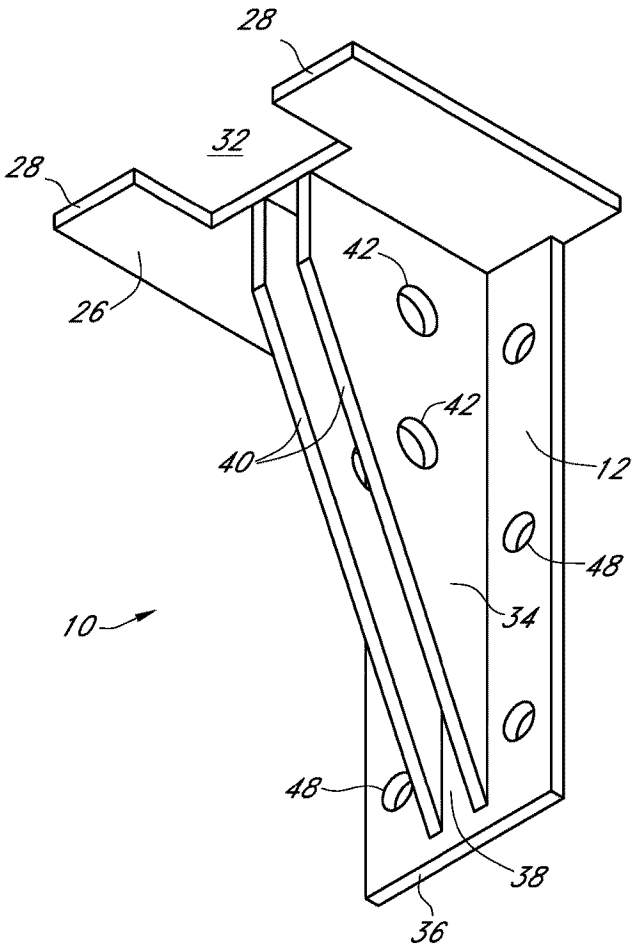
FIG. 1 is a perspective view of a device for mounting wall objects.
Figure 3:
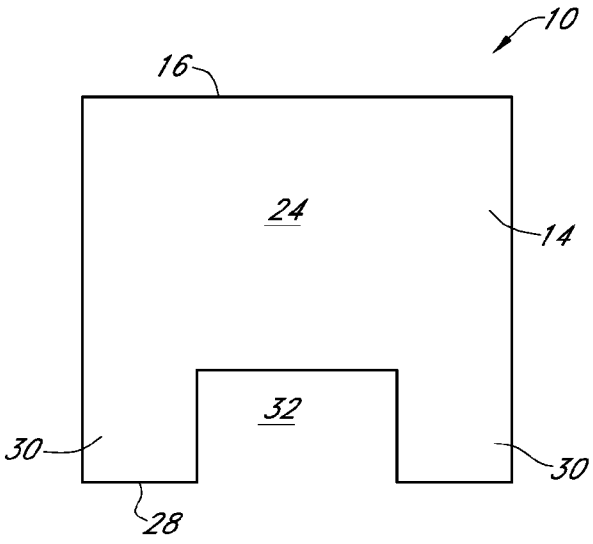
FIG. 3 is a top view of a device for mounting wall objects.
Figure 2:
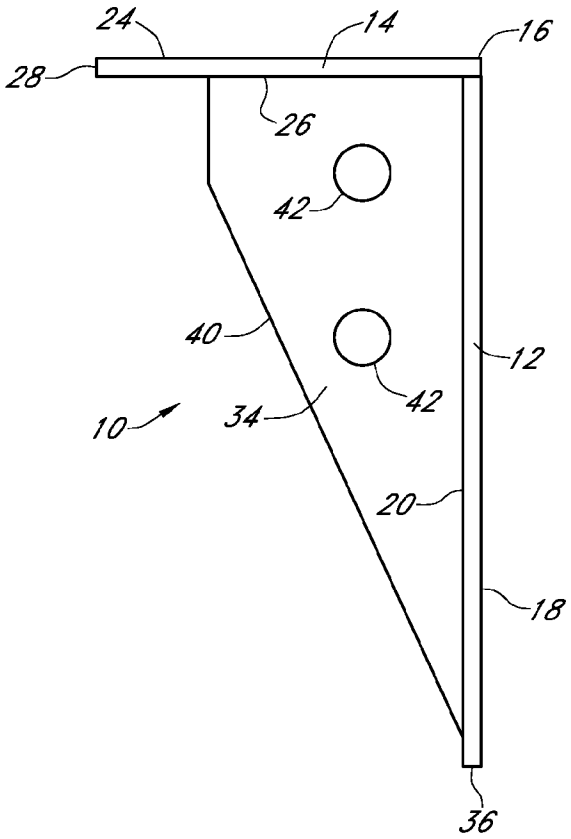
FIG. 2 is a side view of a device for mounting wall objects.
Figure 5:
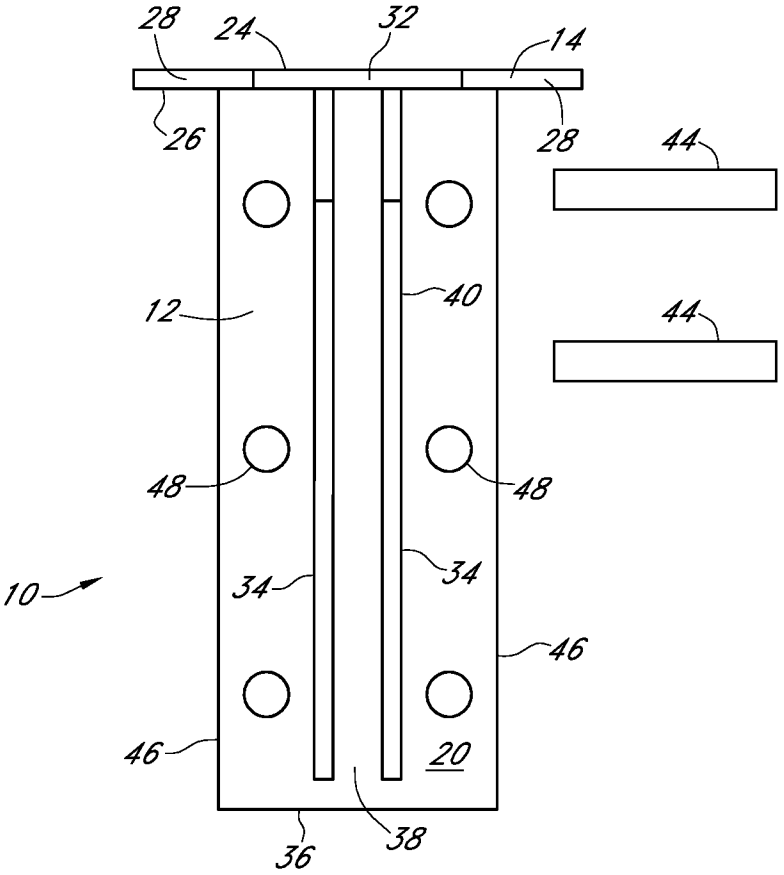
FIG. 5 is a front view of a device for mounting wall objects.
Figure 4:
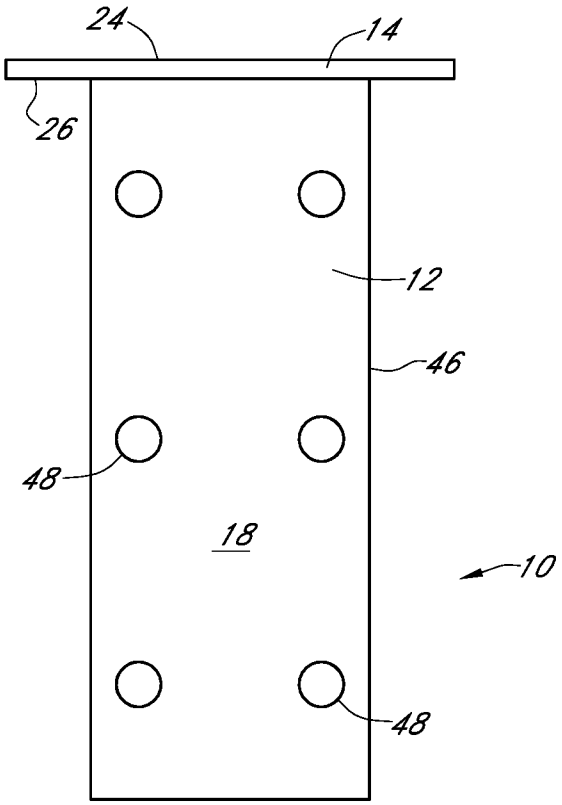
FIG. 4 is a rear view of a device for mounting wall objects.
Figure 6:
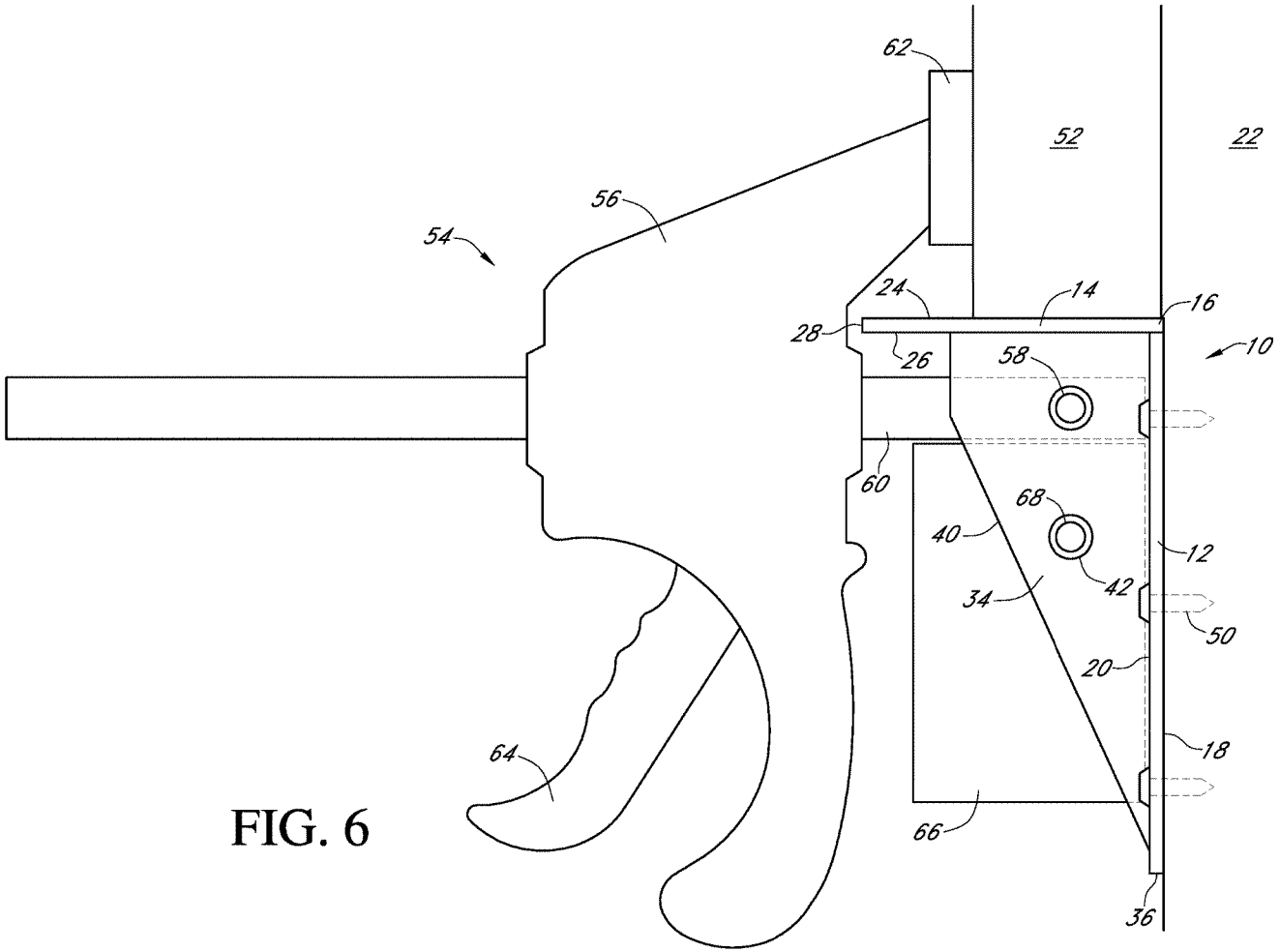
FIG. 6 is a side view of a device for mounting wall objects.

In general, the present invention relates to a device for mounting wall objects. The mounting device has a vertical member and a horizontal member attached to one another along a fold line. The vertical member has a wall-facing side that engages and is secured to a wall or surface by receiving connection members through one or more mounting holes. The horizontal member, in some arrangements, has a pair of flanges that form a gap along an outer end opposite the fold line. A pair of spaced-apart support braces that form a slot extend generally down the middle between the horizontal and vertical member. The slot allows for the reception of a brace or clamp that can be held in place by inserting a locking pin through aligned sets of locking holes and through either a brace hole in the brace or a fixing hole in a transverse hole of the clamp.

The mounting device allows a single individual to mount objects to a surface without the assistance of others. By securing one or more mounting devices to a surface one at a time along a horizontal place, a single individual establishes a level surface to position the desired object on. Once secured, the individual can either use one hand to hold the object in place while using the free hand to secure the object to the surface or they can use a clamp or clamps that are attached to a slot of the mounting device to hold the object in place, thereby freeing both hands to secure the object to the surface. Under either scenario, the individual is safer and the quality of the project is maintained. After the object is secured to the surface, any clamps are removed along with the mounting device leaving little, if any visible damage to the surface.

DETAILED DESCRIPTION

Referring to the Figures, a mounting device 10 has a vertical member 12 and a horizontal member 14 joined at a weld or fold line 16 such that the vertical member 12 and the horizontal member 14 are generally perpendicular to one another and form an upside down L-shape. In one embodiment of the present invention, the vertical member 12 and the horizontal member 14 are flat planar surfaces. In one arrangement, the vertical member 12 is broader than the horizontal member 14.

The vertical member 12 has a first or wall-facing side 18 and a second or opposing side 20 opposite of the wall-facing side 18. The wall-facing side 18 engages a wall or surface 22.

The horizontal member 14 has a first or top side 24 and a second or bottom side 26. Opposite the fold line 16, at an outer end 28 of the horizontal member 14 are a pair of outwardly extending flanges 30 that form a gap 32 between the flanges 30.

Attached to the opposing side 20 of the vertical member 12 and the bottom side 26 of the horizontal member 14 are a pair of support braces 34. In other arrangements, more than two support braces 34 extend between the vertical member 12 and the horizontal member 14. In one embodiment, the pair of support braces 34 are welded to the vertical member 12 and the horizontal member 14. In one example of the present invention, the pair of support braces extend from the gap 32 of the horizontal member 14 to a bottom end 36 or adjacent the bottom end 36 of the vertical member 12. The pair of support braces 34 are spaced apart such that a slot 38 is formed between the pair of support braces 34. When more than two support braces 34 are present, multiple slots 38 are formed, with a slot 38 being formed between each pair of braces 34.

In one arrangement, the pair of support braces 34 each have an outer edge 40. The outer edge 40 extends from the vertical member 12 to the horizontal member 14 opposite from the connection of the pair of support braces 34 to the opposing side 20 and bottom side 26. As shown in the illustrative embodiment of the invention, the outer edges 40 angles inwardly from the horizontal member 14 to the vertical member 12. In another arrangement, only a portion or at least a portion of the outer edges 40 of the pair of support braces 34 angle inwardly. The pair of support braces 34 have one or more set of locking holes 42 that are aligned with one another to receive at least one locking pin 44 within each set of the locking holes 42.

The vertical member 12 has a pair of side edges 46 that extend between the bottom end 36 and the fold line 16. Positioned between the side edges 46 and the pair of support braces 34 are one or more mounting holes 48 that are sized and shaped to receive a connection member 50. In one example, the connection member 50 is a screw, but in other arrangements is a nail, adhesive, or the like.

In one embodiment of the present invention, the mounting device 10 is made of gusset plate or structural steel to provide superior durability and structural integrity, such that an object 52 having a large weight can be supported by the mounting device. In other embodiments, the mounting device 10 is made of other suitable materials that are durable and provide structural integrity.

In operation, a plurality of mounting devices 10 are secured to the surface 22 with connection members 50 that are inserted into the mounting holes 48 and into the surface 22. For instance, two mounting devices 10 are secured to the surface 22, although in other instances three or more mounting devices 10 are used. The mounting devices 10 are secured to the surface 22 such that the horizontal members 14 dwell in the same horizontal plane. Because the mounting devices 10 are relatively small in size and are lightweight, and can be installed one at a time, an individual can manipulate the mounting devices 10 without the assistance of others while securing them to the surface 22. In arrangements where the outer edges 40 angle inwardly, the insertion and securement of the connection members 50 to the surface 22 is facilitated by the angle of the pair of support braces 34 that occupy less space while still providing support to the mounting device 10. The use of an angled outer edge 40 also reduces cost as less material is needed to produce the mounting device 10.

When mounting objects 52 that are relatively easy to manipulate due to either being small, lightweight, or a combination of both, the object 52 is placed on the now level horizontal members 14 of the mounting devices 10 and is held in place manually by the individual while the object 52 is secured to the surface 22 by one or more connection member 50. In some instances of the present invention used to mount lighter objects 52, the connection member 50 is adhesive placed on the wall-facing side 18 of the vertical member 12 to secure to the surface 22 instead of nails or screws 50. Adhesive 50 can also be used in operation to temporarily hold lighter objects 52 to the surface 22 while more permanent connection members 50 are used, such as screws, to secure the mount. Once the object 52 is secured to the surface 22 the mounting devices 10 are removed. When adhesive 50 is used to hold the mounting device 10 in place, no holes are left from securing the mounting devices 10 to the surface 22.

For larger and heavier objects 52 a clamp 54 is used with the mounting device 10. While any type of clamp 54 can be used, as one example the clamp 54 has a body 56 with a transverse rod 58 slidably receive and extending through the body 56 with a fixing hole 60 positioned on at least one end of the transverse rod 60. The body 56 has a movable chuck 62 extending upwardly and towards the fixing hole 58 and a trigger 64 extending downwardly and away in the opposite direction as the chuck 62.

The transverse rod 62 is inserted in the slot 38 between support braces 32 and fixing hole 58 is aligned with one of the sets of locking holes 42 of the pair of support braces. The locking pin 44 is inserted through the set of locking holes 42 and the fixing hole 58. In this manner, the transverse rod 60 is attached to the mounting device 10 and substantially held in place by the narrow space provided by the slot 38, which, as shown in the illustrative embodiment, is sized and shaped to receive the transverse rod 60.

To provide additional support, a brace 66 having a brace hole 68 is inserted into the slot 38 below the transverse rod 60. Another locking pin or second locking pin 44 is inserted through another set of locking holes 42 and the brace hole 68 to hold the brace 66 in place within the slot 38.

Once the clamp 54 is attached to the mounting device 10 the object 52 is placed on the horizontal members 14 of mounting devices 10. Next, by activating the trigger 64, the body 54 of the clamp 54 is slid on the transverse rod 60 so that the movable chuck 62 engages the object 52. For larger objects, the body 56 will not engage the mounting device 10. In other instances, the object 52 will be sufficiently thin as to require the clamp 54 to be slid very close to the surface 22. In these instances, the gap 32 between the flanges 30 of the horizontal member 14 provide additional space for the body 56 of the clamp 54 to slid closer to engage thin objects 52. At the same time, the presence of the flanges 30 provide an area or platform for the object to set on, especially in those instances where clamps 54 are not being used.

Once engaged by the one or more clamps 54 the heavier object 52 is sufficiently held in place by the mounting device 10 and clamp 54 along the horizontal plane to allow the individual to work without the assistance of others. The object 52 is then secured to the surface 22 with one or more connection member 50. Afterwards, the clamps 54 are released, and the mounting devices 10 are removed from the surface 22 leaving the object 52 mounted to the surface 22.

In other uses, the mounting device 10 is used with the object 52 to hold down the object 52 against a workbench or sawhorse 70 (not shown) for using a tool 72 (not shown) on the object 52. The tool 72 can include a router, saw, or the like.

Therefore, a device for mounting wall objects has been provided that allows an individual to hang an object without the assistance of another person, makes it easy to level an object, works with objects of various sizes, shapes, and weights, limits the damages caused to surfaces, is small in size, is lightweight, accommodates various sizes of clamps, works without clamps, is high quality and durable, is easy to use, is low cost to make, and improves upon the art.

From the above discussion and accompanying figures and claims it will be appreciated that the mounting device 10 offers many advantages over the prior art. It will be appreciated further by those skilled in the art that other various modification could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A device for mounting wall objects comprising:

a vertical member extending from a bottom end to a top end;

a horizontal member extending from an outer end to an inner end;

the top end of the vertical member attached to the inner end of the horizontal member;

the vertical member having a wall-facing side and an opposing side, wherein the wall-facing side is configured to engage a surface;

the horizontal member having a top side and a bottom side;

a pair of support braces centrally located, attached to and extending between the opposing side of the vertical member and the bottom side of the horizontal member; and the horizontal member having a pair of outwardly extending flanges that form a gap between the pair of outwardly extending flanges and along an outer end opposite the connection to the vertical member such that the horizontal member and the pair of outwardly extending flanges form a general U-shape.

2. The device of claim 1 wherein at least a portion of the pair of support braces angle inwardly from the horizontal member to the vertical member.

3. The device of claim 1 further comprising a slot between the pair of support braces.

4. The device of claim 1 wherein the pair of support braces extend from the gap of the horizontal member adjacent the bottom end of the vertical member.

5. The device of claim 1 further comprising at least one mounting hole positioned adjacent the pair of support braces.

6. The device of claim 5 further comprising a connection member received within each of the at least one mounting hole.

7. The device of claim 1 further comprising the pair of support braces having at least one set of locking holes that are aligned with one another.

8. The device of claim 7 further comprising a brace having a brace hole, received within a slot formed by the pair of support braces.

9. The device of claim 8 further comprising a locking pin received through one set of locking holes and the brace hole of the brace, such that the brace is connected to the pair of support braces.

10. The device of claim 7 further comprising a clamp having a transverse rod with a fixing hole, wherein the transverse rod is received within a slot formed by the pair of support braces.

11. The device of claim 10 further comprising a locking pin received through one set of locking holes and the fixing hole of the transverse rod, such that the transverse rod is connected to the pair of support braces.

12. The device of claim 1 further comprising the vertical member secured to a surface by at least one connection member.

13. The device of claim 12 further comprising an object positioned on the top side of the horizontal member.

14. The device of claim 1 wherein the vertical member, the horizontal member, and the support braces are made of gusset plate.

15. The device of claim 1 wherein only a portion of the pair of support braces angle inwardly from the horizontal member to the vertical member.

16. The device of claim 1 wherein the vertical member is narrower than the horizontal member.

17. The device of claim 1 wherein the vertical member and horizontal member are perpendicular to one another to form an L-shape.

18. A device for mounting wall objects comprising:

a vertical member attached to a horizontal member along a fold line;

the vertical member having a wall-facing side and an opposing side, wherein the wall-facing side is configured to engage a surface;

the horizontal member having a top side and a bottom side;

a pair of support braces centrally located, attached to and extending between the opposing side of the vertical member and the bottom side of the horizontal member;

the horizontal member having a pair of outwardly extending flanges that form a gap between the pair of outwardly extending flanges and along an outer end opposite the fold line such that the horizontal member and the pair of outwardly extending flanges form a general U-shape; and a brace received within a slot formed by the pair of support braces.

19. The device of claim 18 wherein the brace provides additional support to an object when the vertical member is attached to a surface and the object is placed on a top side of the horizontal member.

20. A device for mounting wall objects comprising:

a vertical member attached to a horizontal member along a fold line;

the vertical member having a wall-facing side and an opposing side, wherein the wall-facing side is configured to engage a surface;

the horizontal member having a top side and a bottom side;

a pair of support braces attached to and extending between the opposing side of the vertical member and the bottom side of the horizontal member; and a clamp having a body, a moveable chuck, and a transverse rod slidably received by the body, wherein the transverse rod is received within a slot formed by the pair of support braces.

* * * * *